US010613454B1

(12) United States Patent
Noguchi et al.

(10) Patent No.: US 10,613,454 B1
(45) Date of Patent: Apr. 7, 2020

(54) DEVELOPING DEVICE AND IMAGE FORMING APPARATUS WITH EXHAUST PORT FOR DISCHARGING AIR

(71) Applicant: FUJI XEROX CO., LTD., Tokyo (JP)

(72) Inventors: Ayumi Noguchi, Kanagawa (JP); Shinichi Kuramoto, Kanagawa (JP); Norihiro Tamazawa, Kanagawa (JP); Yoshitaka Nakajima, Kanagawa (JP); Tomoyuki Yoshii, Kanagawa (JP); Masanori Kato, Kanagawa (JP); Ryota Tomishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/285,237

(22) Filed: Feb. 26, 2019

(30) Foreign Application Priority Data

Sep. 20, 2018 (JP) ..... 2018-176572

(51) Int. Cl.
*G03G 15/08* (2006.01)
*G03G 21/20* (2006.01)

(52) U.S. Cl.
CPC ..... *G03G 15/0896* (2013.01); *G03G 21/206* (2013.01); *G03G 2221/1645* (2013.01)

(58) Field of Classification Search
CPC ..... G03G 15/081; G03G 15/0896; G03G 21/206; G03G 2221/16456
USPC ..... 399/92, 99
See application file for complete search history.

(56) References Cited

U.S. PATENT DOCUMENTS

| | | | | |
|---|---|---|---|---|
| 4,583,112 | A * | 4/1986 | Morano | G03G 15/0898 399/103 |
| 5,682,578 | A * | 10/1997 | Shehata | G03G 15/0898 399/355 |
| 9,195,168 | B2 * | 11/2015 | Ishii | G03G 15/0896 |
| 9,244,376 | B2 * | 1/2016 | Kuramoto | G03G 15/0806 |
| 10,088,771 | B1 * | 10/2018 | Kuramoto | G03G 15/0808 |
| 2009/0060560 | A1 * | 3/2009 | Tamura | G03G 15/0815 399/92 |
| 2018/0267427 | A1 * | 9/2018 | Kuramoto | G03G 15/0822 |

FOREIGN PATENT DOCUMENTS

| | | | | |
|---|---|---|---|---|
| JP | 06027795 | A * | 2/1994 | G03G 15/0898 |
| JP | 2006250973 | A * | 9/2006 | |
| JP | 2008026487 | A * | 2/2008 | |
| JP | 2008225274 | A * | 9/2008 | |
| JP | 2013125148 | A * | 6/2013 | |
| JP | 2015072331 | | 4/2015 | |
| JP | 2016118633 | | 6/2016 | |

* cited by examiner

*Primary Examiner* — Robert B Beatty
(74) *Attorney, Agent, or Firm* — JCIPRNET

(57) ABSTRACT

A developing device includes: a container for accommodating developer, the container having an exhaust port; and a merging section where airflows directed from the interior of the container to the exhaust port join together.

16 Claims, 11 Drawing Sheets

DEVELOPING DEVICE AND IMAGE FORMING APPARATUS WITH EXHAUST PORT FOR DISCHARGING AIR

CROSS-REFERENCE TO RELATED APPLICATIONS

This application is based on and claims priority under 35 USC 119 from Japanese Patent Application No. 2018-176572 filed Sep. 20, 2018.

BACKGROUND

(i) Technical Field

The present disclosure relates to developing devices and image forming apparatuses.

(ii) Related Art

Japanese Unexamined Patent Application Publication No. 2015-72331 discloses an image forming apparatus including an image carrier that carries an image, a container for accommodating developer, and an introduction flow path through which air is introduced into the container.

Japanese Unexamined Patent Application Publication No. 2016-118633 discloses an image forming apparatus including a suction duct, which constitutes an air flow path through which toner scattering from the surface of a developer carrier is sucked from a suction port.

SUMMARY

If the internal pressure of a container accommodating developer is high, it is desirable to provide an exhaust port to release the air inside the container to the outside. In that case, if the air directed to the exhaust port contains the developer, the developer is likely to be discharged outside the container.

Aspects of non-limiting embodiments of the present disclosure relate to a reduction in the amount of the developer contained in the air directed to an exhaust port provided in a developer container, compared with the configuration in which the air directed to the exhaust port reaches the exhaust port through only one straight flow path.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including: a container for accommodating developer, the container having an exhaust port; and a merging section where airflows directed from an interior of the container to the exhaust port join together.

BRIEF DESCRIPTION OF THE DRAWINGS

Exemplary embodiment of the present disclosure will be described in detail based on the following figures, wherein.

DETAILED DESCRIPTION

Exemplary embodiments of the present disclosure will be described below with reference to the attached drawings.

Figure 1:
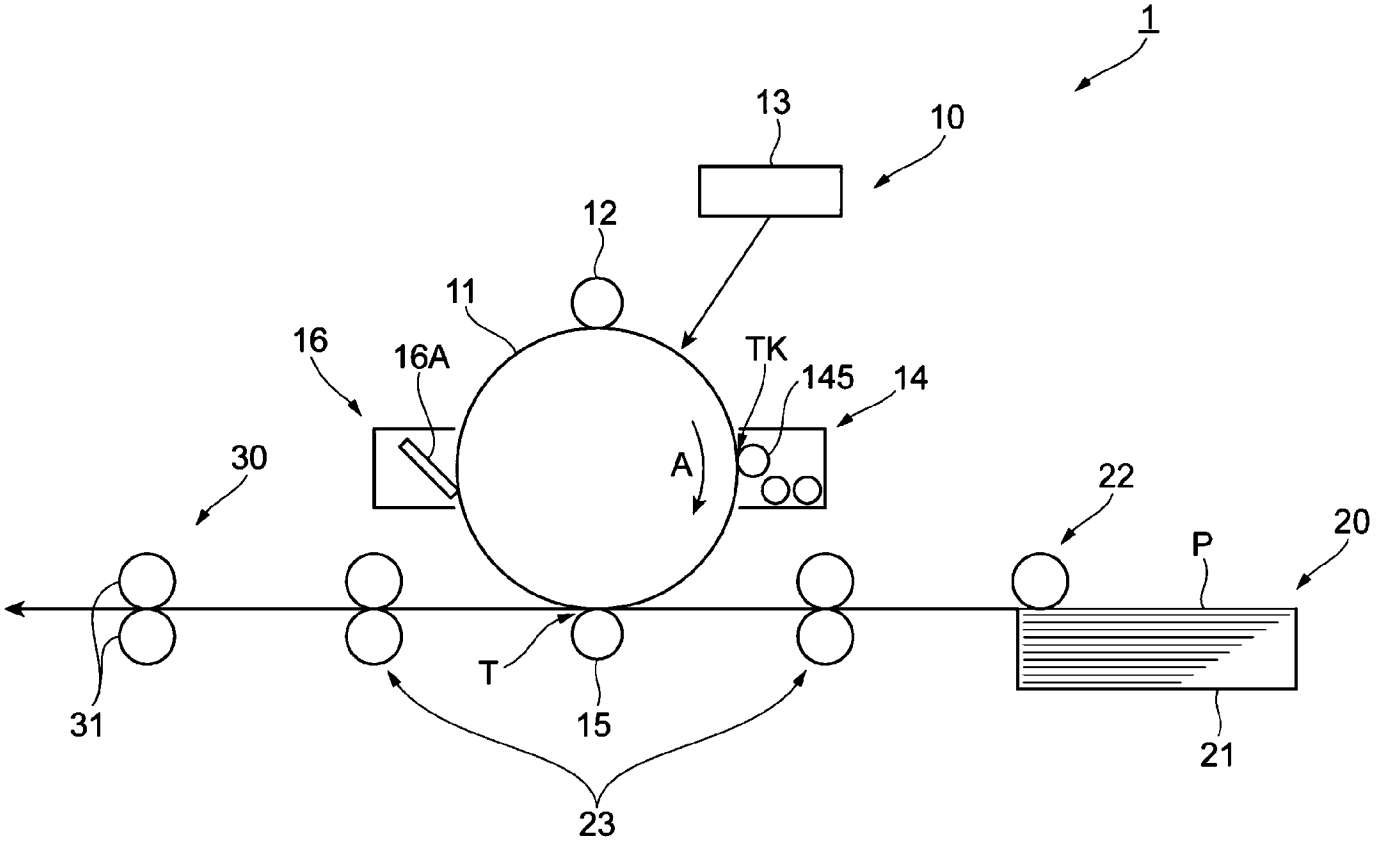
FIG. 1 shows the overall configuration of an image forming apparatus.

FIG. 1 shows the overall configuration of an image forming apparatus 1. More specifically, FIG. 1 shows the image forming apparatus 1, as viewed from the front side.

The image forming apparatus 1 includes an image forming unit 10, a sheet feed unit 20, and a fixing unit 30.

The image forming unit 10 forms a toner image on a sheet P by using an electrophotographic system. The sheet feed unit 20 supplies a sheet P to the image forming unit 10. The fixing unit 30 fixes the toner image (image), which has been formed on the sheet P by the image forming unit 10, to the sheet P.

The image forming unit 10 includes: a photoconductor drum 11, which rotates in the arrow A direction; a charging roller 12; an exposure device 13; a developing device 14; a transfer roller 15; and a cleaning device 16.

The photoconductor drum 11, serving as an example image carrier, is a cylindrical member and has a photosensitive layer (not shown) on the surface thereof.

The charging roller 12 is formed of, for example, a conductive rubber roller and charges the photoconductor drum 11.

The exposure device 13 irradiates the photoconductor drum 11 charged by the charging roller 12 with light emitted from a light source, such as a laser light source or a light emitting diode (LED), to form an electrostatic latent image on the surface of the photoconductor drum 11.

The developing device 14 allows toner of a predetermined color to adhere to the surface of the photoconductor drum 11, thus developing the electrostatic latent image formed on the photoconductor drum 11. This way, the toner image is formed on the surface of the photoconductor drum 11 in this exemplary embodiment.

The developing device 14 accommodates developer. In this exemplary embodiment, the developer is a so-called two-component developer, which is composed of magnetic carrier and colored toner.

The transfer roller 15 is formed of a conductive rubber roller or the like.

In this exemplary embodiment, the portion at which the transfer roller 15 and the photoconductor drum 11 face each other constitutes a transfer part T, and the toner image formed on the surface of the photoconductor drum 11 is transferred to a sheet P transported thereto, at the transfer part T.

The cleaning device 16 includes a contact member 16A disposed so as to be in contact with the photoconductor drum 11. The cleaning device 16 removes the toner and the other substances on the photoconductor drum 11.

The sheet feed unit 20 includes a sheet container 21, which accommodates sheets P, and a feed mechanism 22, which feeds a sheet P from the sheet container 21.

Furthermore, in this exemplary embodiment, sheet transport mechanisms 23, which transport, via the transfer part T and the fixing unit 30, the sheet P fed out from the sheet feed unit 20 are provided.

The fixing unit 30 includes a pair of rotary members 31, which rotate in a contact state.

One of the pair of rotary members 31 has a built-in heat source (not shown).

The two rotary members 31 in the fixing unit 30 apply heat and pressure to the sheet P to fix the toner image formed on the sheet P to the sheet P.

An image forming operation performed by the image forming apparatus 1 will be described.

In the image forming unit 10, the photoconductor drum 11 rotating in the arrow A direction is charged by the charging roller 12. Subsequently, the exposure device 13 exposes the photoconductor drum 11 to light to form, on the surface thereof, an electrostatic latent image corresponding to image information.

Subsequently, the developing device 14 develops the electrostatic latent image, thus forming a toner image corresponding to the electrostatic latent image on the surface of the photoconductor drum 11.

The toner image formed on the photoconductor drum 11 is moved to the transfer part T as the photoconductor drum 11 rotates. A sheet P fed out of the sheet feed unit 20 is transported to the transfer part T by the sheet transport mechanisms 23.

The toner image formed on the photoconductor drum 11 is transferred to the sheet P transported thereto at the transfer part T. Subsequently, the sheet P having the toner image transferred thereto is heated and pressed while passing through the fixing unit 30. Thus, the toner image is fixed to the sheet P.

Figure 2:
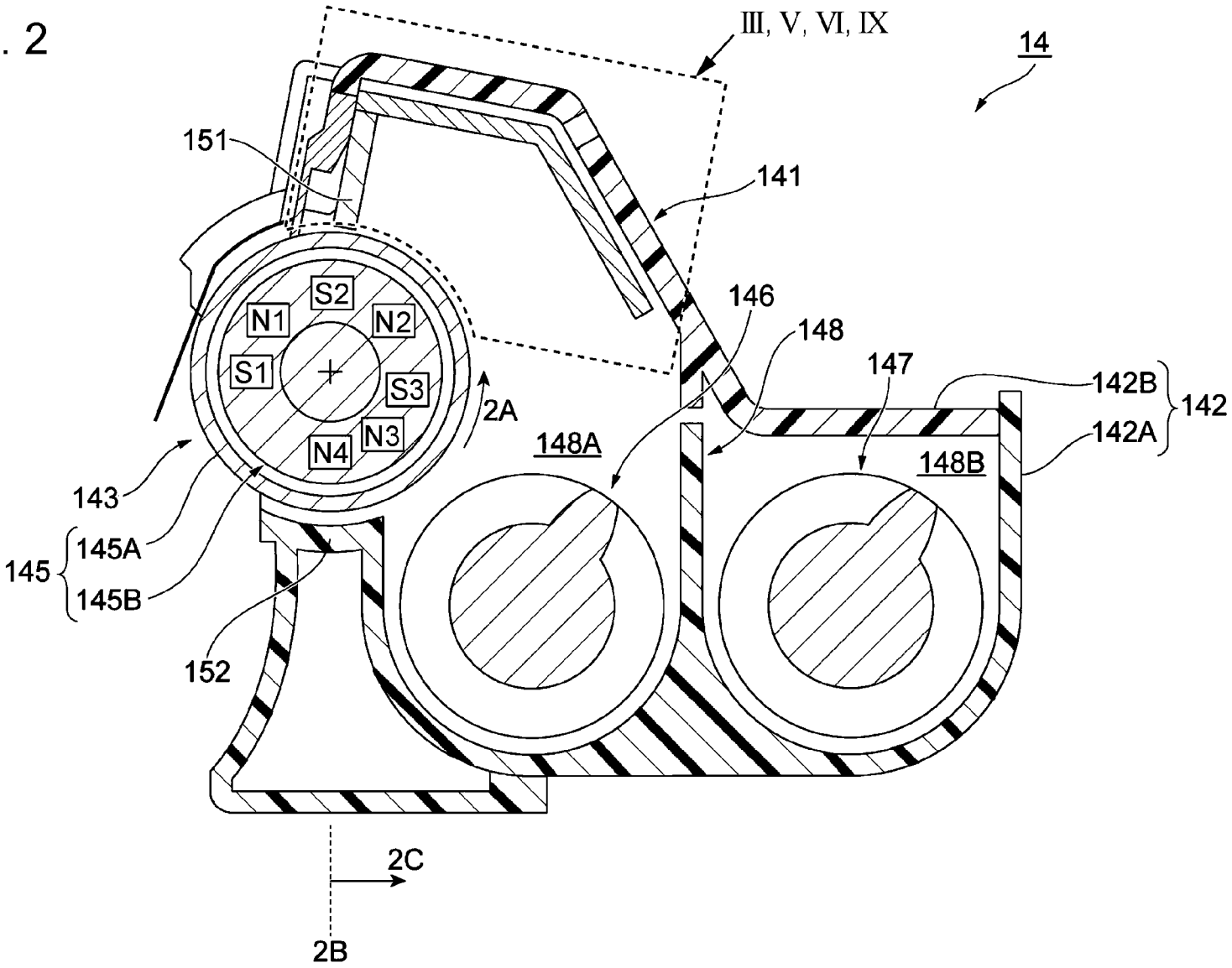
FIG. 2 shows a developing device.

FIG. 2 shows the developing device 14.

The developing device 14 includes a container 141 that accommodates developer (not shown) therein. The container 141 includes a container frame 142, which is made of resin.

The container frame 142 (developing device 14) extends in the direction from the front side to the rear side of the image forming apparatus 1 (i.e., the direction perpendicular to the plane of the sheet of FIG. 2) and has a far-side end (not shown) on the rear side and a near-side end (not shown) on the front side.

The container frame 142 includes a lower housing 142A, which is located on the lower side, and an upper housing 142B, which is located above the lower housing 142A.

The container frame 142 has an opening 143 at a portion facing the photoconductor drum 11 (see FIG. 1).

A developing roller 145 that allows the developer to adhere to the surface of the photoconductor drum 11 is provided at the opening 143. The developing roller 145 has a cylindrical shape and extends in the direction from the front side to the rear side of the image forming apparatus 1 (i.e., the direction perpendicular to the plane of the sheet of FIG. 2).

The developing roller 145 includes a developing sleeve 145A, which is a drivingly rotatable cylindrical member, and a magnet roller 145B disposed inside the developing sleeve 145A.

The developing sleeve 145A is formed of a metal, such as stainless steel (SUS).

The developing sleeve 145A rotates in the arrow 2A direction in FIG. 2. In other words, the developing sleeve 145A rotates in such a manner that a portion thereof facing the interior of the container 141 (i.e., a portion located inside the container 141) moves upward. More specifically, the developing sleeve 145A rotates in such a manner that a portion located on the arrow 2C side with respect to the dashed line 2B moves upward.

In this exemplary embodiment, the developing sleeve 145A and the photoconductor drum 11 rotate so as to move in the same direction at a facing part TK (see FIG. 1), where the developing roller 145 and the photoconductor drum 11 face each other.

As shown in FIG. 2, the developing device 14 includes a first transport member 146 and a second transport member 147, which transport the developer.

The first transport member 146 and the second transport member 147 are provided on the opposite side of the developing roller 145 from the photoconductor drum 11 (see FIG. 1).

In this exemplary embodiment, the first transport member 146 is located closer to the photoconductor drum 11, and the second transport member 147 is located farther from the photoconductor drum 11.

The first transport member 146 and the second transport member 147 are located below the developing roller 145.

The first transport member 146 extends in the direction from the front side to the rear side of the image forming apparatus 1 (i.e., the direction perpendicular to the plane of the sheet of FIG. 2) and transports the developer to, for example, the far side of the plane of the sheet of FIG. 2 (i.e., the rear side of the image forming apparatus 1).

The second transport member 147 is also disposed so as to extend in the direction from the front side to the rear side of the image forming apparatus 1 (i.e., the direction perpendicular to the plane of the sheet of FIG. 2). The second transport member 147 transports the developer to, for example, the front side of the plane of the sheet of FIG. 2 (i.e., the front side of the image forming apparatus 1).

In this exemplary embodiment, the interior space of the container frame 142 is divided by a partition wall 148 into a first space 148A, which is located closer to the photoconductor drum 11, and a second space 148B, which is located farther from the photoconductor drum 11.

In this exemplary embodiment, the first transport member 146 is disposed in the first space 148A, and the second transport member 147 is disposed in the second space 148B.

The partition wall 148 does not extend from end to end in the longitudinal direction of the container frame 142. That is, the partition wall 148 is not provided at the far-side end and the near-side end of the container frame 142.

In other words, there are non-wall portions (i.e., portions where the partition wall 148 is not formed) at both ends in the longitudinal direction of the container frame 142.

This configuration allows the developer to circulate inside the developing device 14 in this exemplary embodiment.

More specifically, in this exemplary embodiment, the developer in the first space 148A is transported to the far side of the plane of the sheet of FIG. 2 by the first transport member 146. The developer that has reached the far-side end of the container frame 142 moves into the second space 148B through the non-wall portion.

The developer that has moved to the second space 148B is transported to the near-side end of the container frame 142 by the second transport member 147. Then, the developer moves to the first space 148A through the non-wall portion on the near-side end.

The developer repeatedly moves in this way, circulating in the developing device 14. In this exemplary embodiment, the developer is stirred by this circulation.

In the developing device 14, a layer restriction part 151 is provided above the developing roller 145. This layer restriction part 151 is disposed at a certain distance (gap) from the developing roller 145.

The layer restriction part 151 controls the thickness of the developer adhered to the surface of the developing roller 145 to a predetermined thickness by preventing movement of part of the developer adhered to the developing roller 145.

The developing device 14 has a lower facing part 152, which faces the developing roller 145, below the developing roller 145.

In this exemplary embodiment, the opening 143 is provided between the layer restriction part 151 and the lower facing part 152, and the developing roller 145 is provided in the opening 143.

Next, the magnet roller 145B disposed inside the developing sleeve 145A will be described.

The magnet roller 145B includes seven magnetic poles, namely, magnetic poles N1 to N4 (N poles) and magnetic poles S1 to S3 (S poles), which are arranged in the circumferential direction of the magnet roller 145B.

The magnetic pole N3 (pickup pole) attracts the developer transported by the first transport member 146 and allows the developer to adhere to the surface of the developing sleeve 145A.

The magnetic pole S2 (trimming pole), together with the layer restriction part 151, controls the thickness of the developer adhered to the surface of the developing roller 145 to a predetermined thickness.

The magnetic poles S3, N2, and N1 serve as transport poles, which transport the toner on the developing sleeve 145A to the downstream side in the rotation direction of the developing sleeve 145A.

The magnetic pole S1 (developing pole), together with the magnetic pole N1 adjacent thereto, form a nap of the developer.

The magnetic pole N4 (pickoff pole), together with the magnetic pole N3 adjacent thereto, forms a repulsive magnetic field to remove the developer adhered to the surface of the developing sleeve 145A from the developing sleeve 145A.

Figure 3:
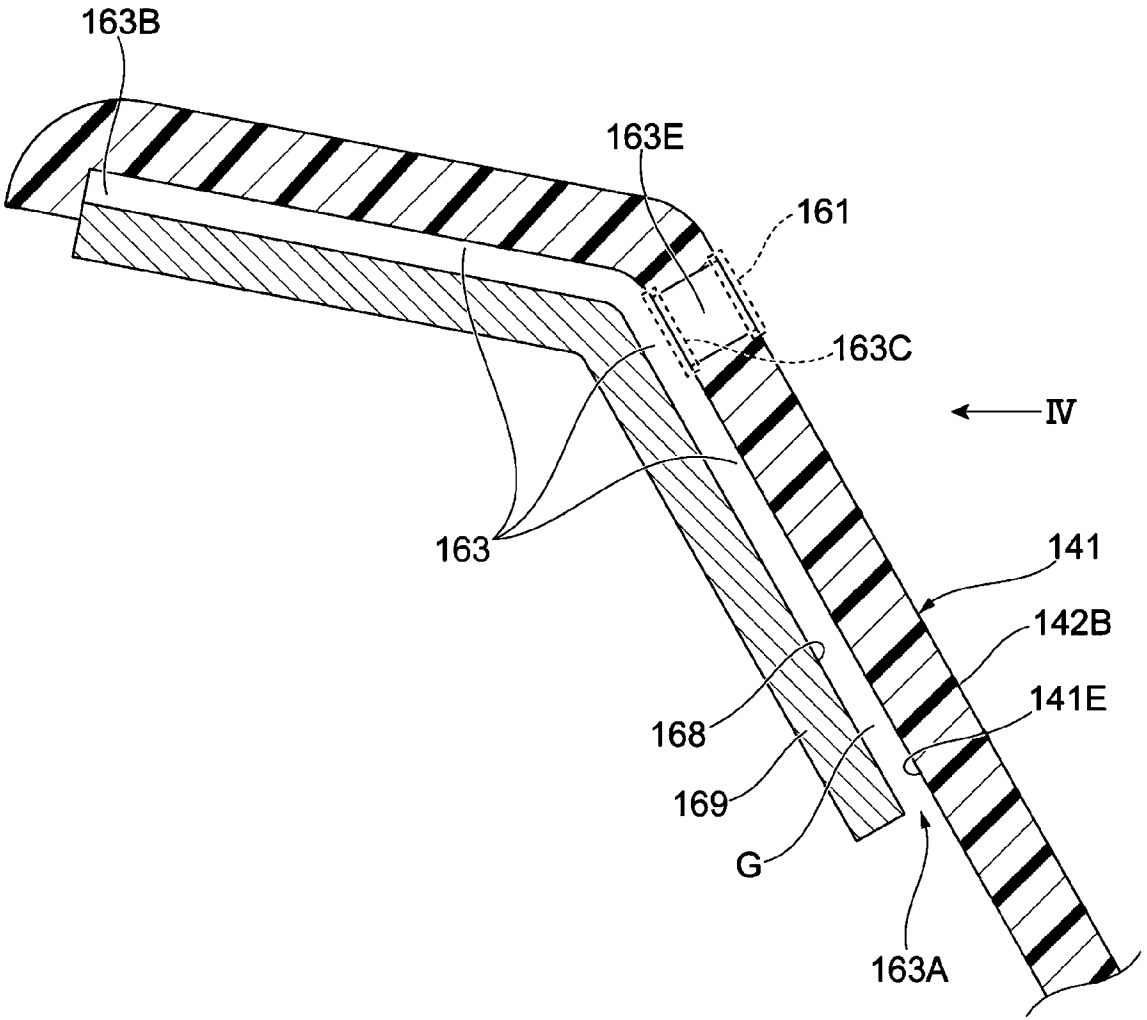
FIG. 3 is an enlarged view of a portion III in FIG. 2.

FIG. 3 is an enlarged view of the portion III in FIG. 2.

As shown in FIG. 3, in this exemplary embodiment, the container 141 (the upper housing 142B) has exhaust ports 161 through which the air inside the container 141 is discharged outside the container 141. Furthermore, an air accommodation space 163, which accommodates the air directed to the exhaust ports 161, is provided inside the container 141.

The air accommodation space 163 has an inlet 163A, through which the air enters the air accommodation space 163. The air accommodation space 163 also has an end 163B at the end opposite to the inlet 163A.

Furthermore, in this exemplary embodiment, discharge portions 163C for discharging the air inside the air accommodation space 163 are provided. The discharge portions 163C are circular holes.

The discharge portions 163C are provided between the inlet 163A and the end 163B of the air accommodation space 163.

Although the discharge portions 163C may be provided anywhere between the inlet 163A and the end 163B, it is desirable that the discharge portions 163C be provided at positions closer to the inlet 163A. More specifically, it is desirable that the discharge portions 163C be provided at positions closer to the inlet 163A than the midpoint of the line segment connecting the inlet 163A and the end 163B (i.e., the line segment extending along the air accommodation space 163) is.

The air accommodation space 163 may be considered as a flow path for the air directed to the exhaust ports 161. In this exemplary embodiment, the discharge portions 163C are provided at a side of the portion constituting the flow path.

In this exemplary embodiment, connecting flow paths 163E, which connect the discharge portions 163C and the exhaust ports 161 and through which the air directed to the exhaust ports 161 passes, are provided.

In this exemplary embodiment, the air inside the air accommodation space 163 is discharged outside the air accommodation space 163 through the discharge portions 163C. The air is directed to the exhaust ports 161 through the connecting flow paths 163E and is discharged from the exhaust ports 161.

The air accommodation space 163 is a gap G formed between an inner surface 141E of the container 141 (the upper housing 142B) and a facing part 168 that faces the inner surface 141E.

More specifically, a plate-shaped facing member 169 is disposed inside the container 141 so as to face the inner surface 141E of the container 141, thus forming the gap G, serving as the air accommodation space 163, between the inner surface 141E of the container 141 and the facing member 169.

Figure 4:
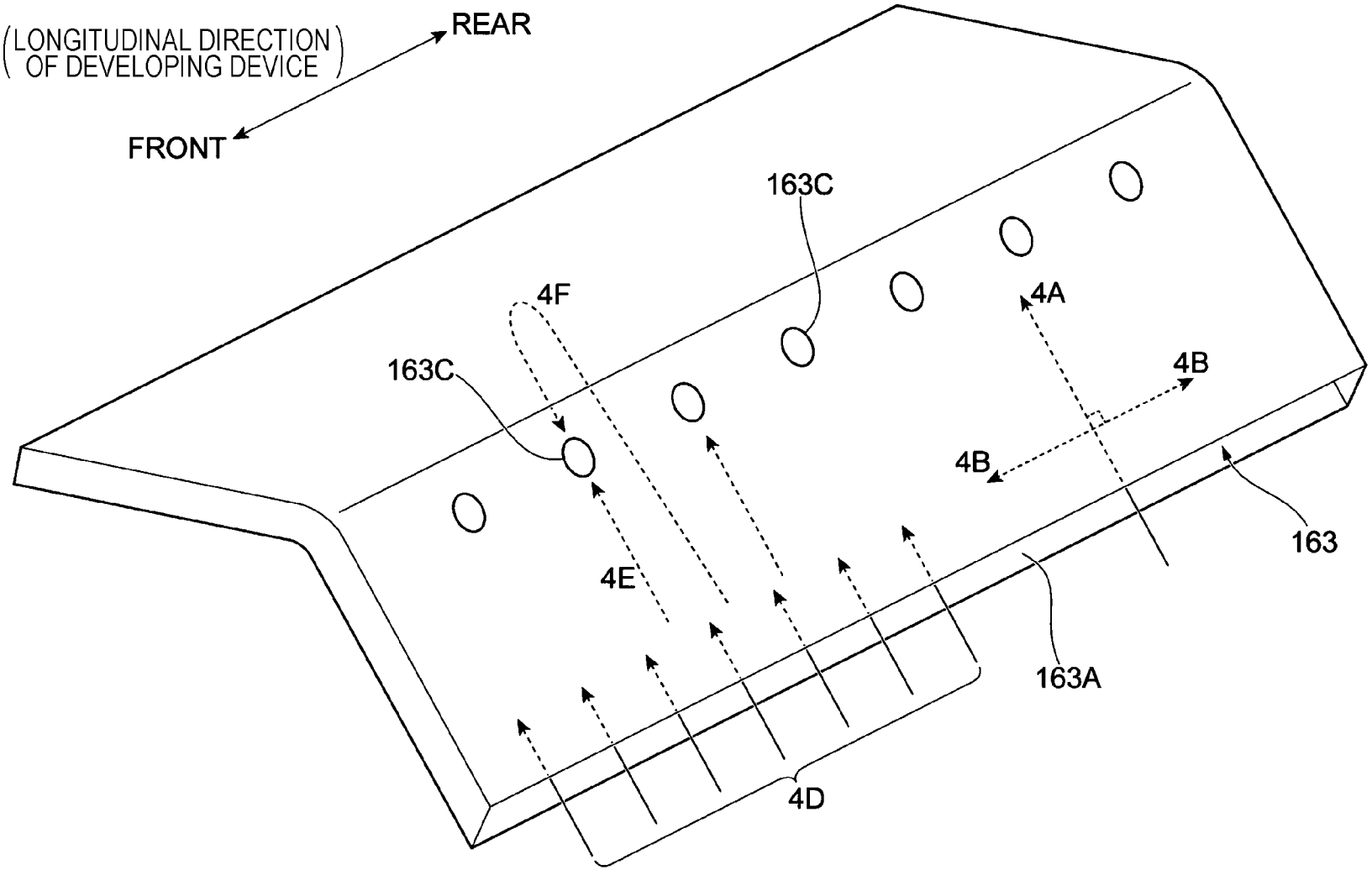
FIG. 4 is a perspective view of an air accommodation space, as viewed in the arrow IV direction in FIG. 3, that is, from the front side of the image forming apparatus.

FIG. 4 is a perspective view of the air accommodation space 163, as viewed in the arrow IV direction in FIG. 3, that is, from the front side of the image forming apparatus 1.

As shown in FIG. 4, in this exemplary embodiment, the discharge portions 163C are circular holes. There are multiple discharge portions 163C.

The discharge portions 163C are provided such that the positions thereof in a direction intersecting the direction of the air directed from the upstream side toward the discharge portions 163C are different from one another.

More specifically, in this exemplary embodiment, the air directed from the upstream side toward the discharge portions 163C flows in the arrow 4A direction. The discharge portions 163C are disposed at different positions in the direction (i.e., the arrow 4B direction) intersecting (perpendicular to) the arrow 4A direction.

The discharge portions 163C are arranged in a line in the arrow 4B direction.

More specifically, in this exemplary embodiment, the air directed from the upstream side toward the discharge portions 163C moves in the direction intersecting (perpendicular to) the longitudinal direction of the developing device 14. The discharge portions 163C are arranged in a line in the longitudinal direction of the developing device 14.

Referring to FIG. 4, the flow of the air in the air accommodation space 163 will be described.

In this exemplary embodiment, as the internal pressure of the container 141 (see FIG. 2) increases, the air inside the container 141 enters the air accommodation space 163 from the inlet 163A of the air accommodation space 163, as indicated by the arrow 4D in FIG. 4.

In this exemplary embodiment, the developer that is adhered to the surface of the developing sleeve 145A (see FIG. 2) and that has passed through the facing part TK (see FIG. 1), at which the developing roller 145 and the photoconductor drum 11 face each other, returns to the container 141. The return of the developer to the container 141 increases the internal pressure of the container 141. In this exemplary embodiment, as the internal pressure of the container 141 increases, the air inside the container 141 enters the air accommodation space 163 from the inlet 163A of the air accommodation space 163, as shown by arrow 4D in FIG. 4.

Subsequently, portions of the air flow toward the discharge portions 163C, as indicated by reference sign 4E, and other portions of the air temporarily flow to the downstream side of the discharge portions 163C and then return toward the discharge portions 163C, as indicated by reference sign 4F.

As a result, in this exemplary embodiment, the portions of the air that directly flow from the upstream side toward the discharge portions 163C and the portions of the air that temporarily flow to the downstream side of the discharge portions 163C and then return toward the discharge portions 163C join together.

More specifically, in this exemplary embodiment, portions facing the discharge portions 163C serve as merging sections. The air flowing from the upstream side in the arrow 4E direction and the air flowing from the downstream side in the arrow 4F direction, which is opposite to the arrow 4E direction, join together at the merging sections.

In this exemplary embodiment, airflows directed in the directions intersecting the longitudinal direction of the developing device 14 join together.

In this exemplary embodiment, this configuration reduces the amount of the developer contained in the air discharged from the exhaust ports 161 (see FIG. 3).

More specifically, developer particles collide with one another at the merging sections, and thus, the moving speed of the developer particles decreases. As a result, the developer particles tend to stay in place. In addition, turbulent flows are likely to occur at the merging sections. The turbulent flows also decrease the moving speed of the developer particles, and thus, the developer particles tend to stay in place.

In this case, the developer tends to stay inside the air accommodation space 163 (see FIG. 4), and thus, the amount of the developer contained in the air discharged from the exhaust ports 161 decreases.

In this exemplary embodiment, the air that directly flows from the upstream side toward the discharge portions 163C (hereinbelow, upstream-side air) and the air that flows from the downstream side toward the discharge portions 163C (downstream-side air) both contain the developer.

In this case, collisions between the developer particles are more likely to occur, thus reducing more developer contained in the air, compared with the configuration in which only one of the upstream-side air and the downstream-side air contains the developer.

That is, more developer contained in the air decreases, compared with the configuration in which only one of the upstream-side air and the downstream-side air, which are to be joined together, contains the developer.

The configuration in this exemplary embodiment may be considered as a configuration having an air flow path through which the air directed toward the exhaust ports 161 passes and a joining flow path that joins the aforementioned air flow path.

Figure 5:
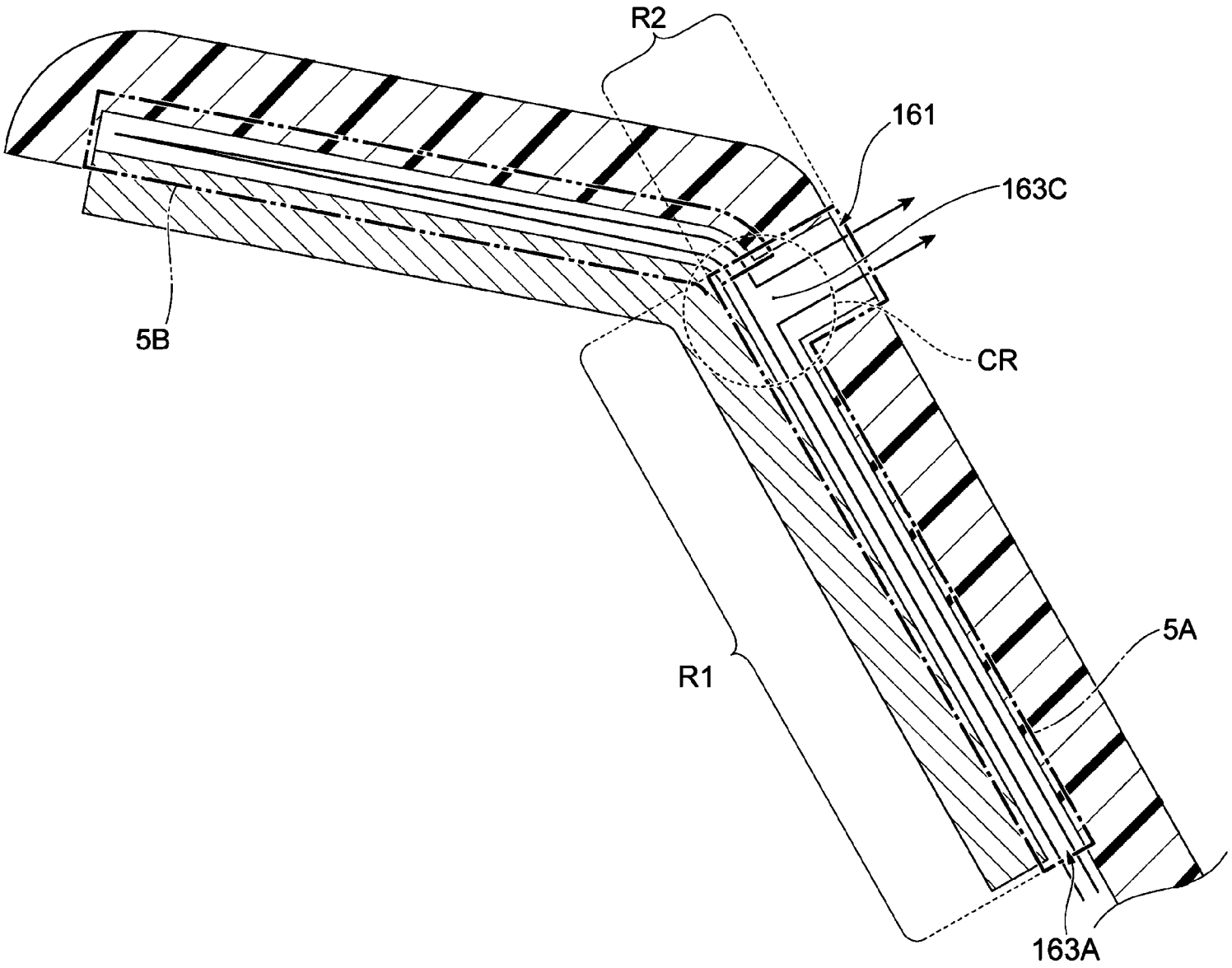
FIG. 5 is an enlarged view of a portion V in FIG. 2.

More specifically, in this exemplary embodiment, an L-shaped flow path indicated by reference sign 5A in FIG. 5 (an enlarged view of the portion V in FIG. 2) may be considered as the air flow path through which the air directed toward the exhaust ports 161 passes. A flow path indicated by reference sign 5B in FIG. 5 may be considered as the joining flow path that joins the aforementioned air flow path.

The air that temporarily flows to the downstream side of the discharge portions 163C enters the joining flow path and returns to the upstream side through the joining flow path to join the air flow path.

More specifically, the air directed toward the exhaust ports 161 temporarily enters the joining flow path and is discharged from the exhaust ports 161 via the air flow path.

The air flow path includes a first flow path R1 and a second flow path R2.

The first flow path R1 extends from the inlet 163A to the downstream side in one direction.

The second flow path R2 is located downstream of the first flow path R1 in the airflow direction and guides the air flowing through the first flow path R1 to the exhaust ports 161.

The second flow path R2 extends in the direction intersecting (perpendicular to) the aforementioned one direction, in which the first flow path R1 extends. The first flow path R1 and the second flow path R2 intersect each other at an intersecting portion CR.

In this exemplary embodiment, the joining flow path joins the intersecting portion CR of the air flow path. The joining flow path extends toward the intersecting portion CR, from the side of the intersecting portion CR opposite to the first flow path R1, and joins the intersecting portion CR.

Figure 6:
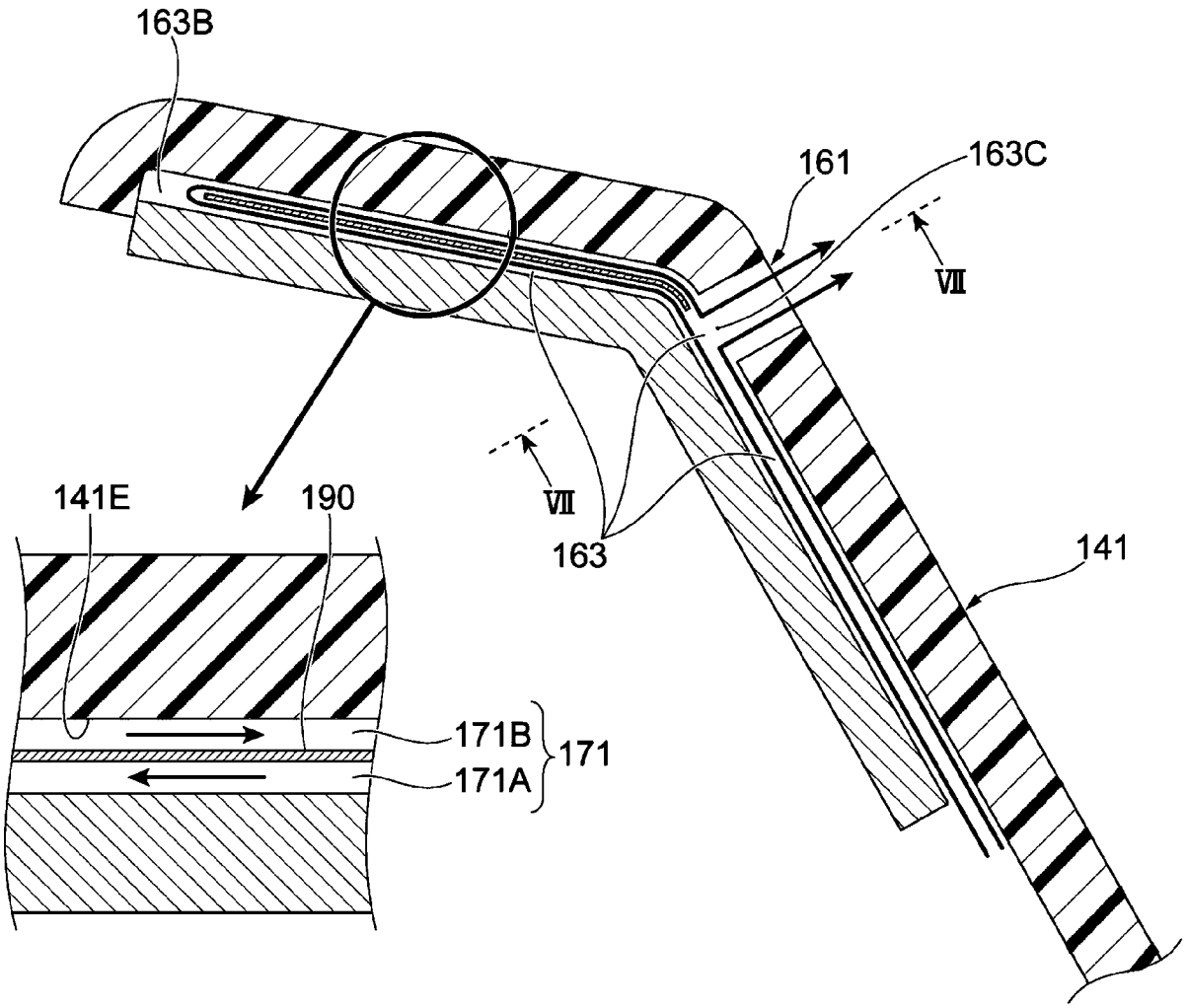
FIG. 6 shows another configuration of a portion VI in FIG. 2.

FIG. 6 shows another configuration of the portion VI in FIG. 2.

In the configuration example shown in FIG. 6, a return flow path is provided in the air accommodation space 163.

More specifically, a partition 190 is provided in the air accommodation space 163 to form, in the air accommodation space 163, a return flow path 171, along which the air temporarily moves toward the end 163B beyond the discharge portions 163C and then returns toward the discharge portions 163C.

The return flow path 171 includes an outgoing flow path 171A and a return flow path 171B.

The outgoing flow path 171A, serving as an example first flow path, is provided on the opposite side of the partition 190 from the inner surface 141E of the container 141. The return flow path 171B, serving as an example second flow path, is provided between the inner surface 141E of the container 141 and the outgoing flow path 171A.

In this configuration example, the air that temporarily moves to the downstream side of the discharge portions 163C passes through the outgoing flow path 171A. The air that has temporarily moved to the downstream side returns toward the discharge portions 163C through the return flow path 171B.

In this configuration example, the air that returns toward the discharge portions 163C through the return flow path 171B and the air that directly flows from the upstream side toward the discharge portions 163C join together.

Figure 7:
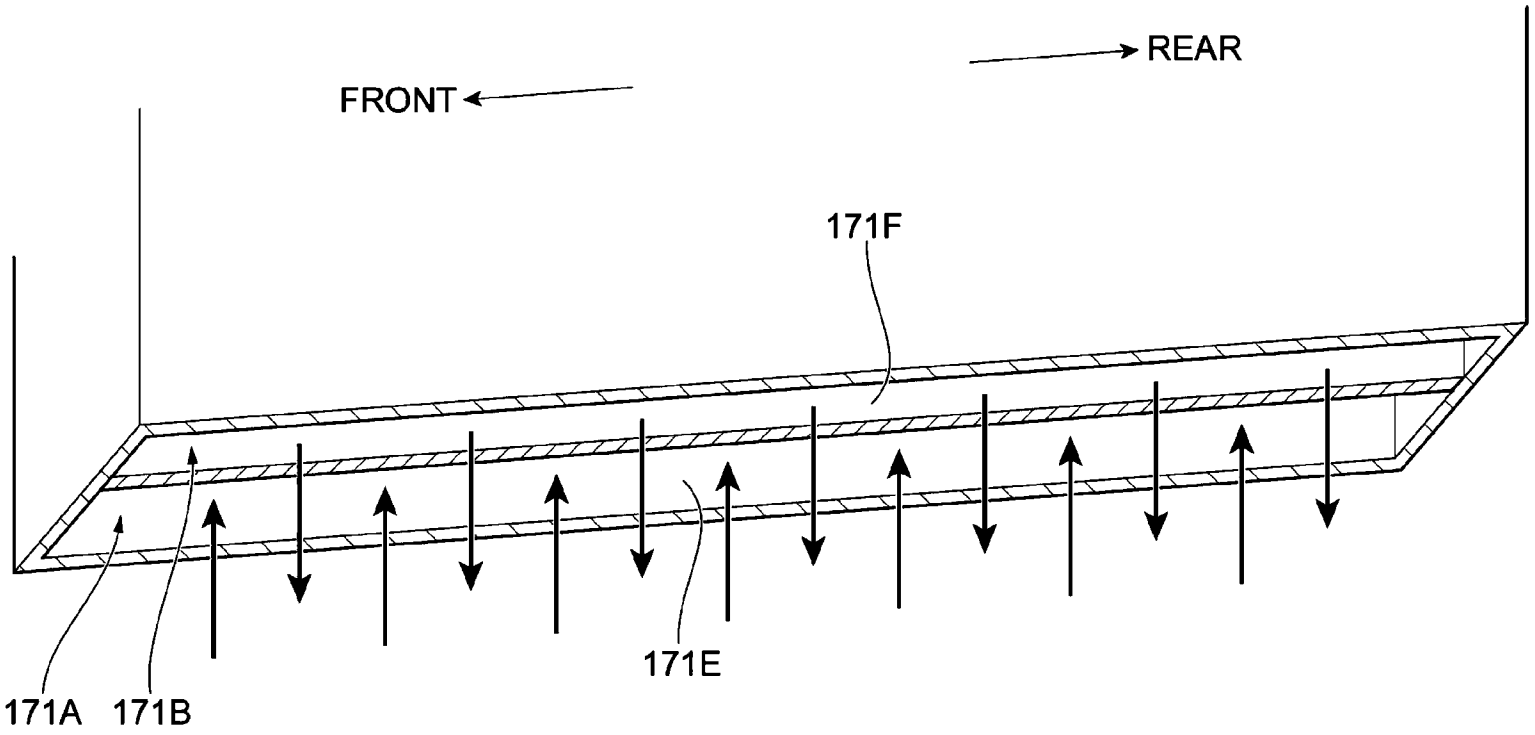
FIG. 7 is a sectional view taken along line VII-VII in FIG. 6.

FIG. 7 is a sectional view taken along line VII-VII in FIG. 6.

As shown in FIG. 7, in this exemplary embodiment, the outgoing flow path 171A has an inlet 171E from which the air enters the outgoing flow path 171A. The return flow path 171B has an outlet 171F from which the air is discharged from the return flow path 171B.

In this exemplary embodiment, the inlet 171E of the outgoing flow path 171A has a greater area than the outlet 171F of the return flow path 171B.

With this configuration, a flow of air flowing along the return flow path 171 is likely to be generated, compared with the configuration in which the inlet 171E of the outgoing flow path 171A and the outlet 171F of the return flow path 171B have the same area.

Figure 8:
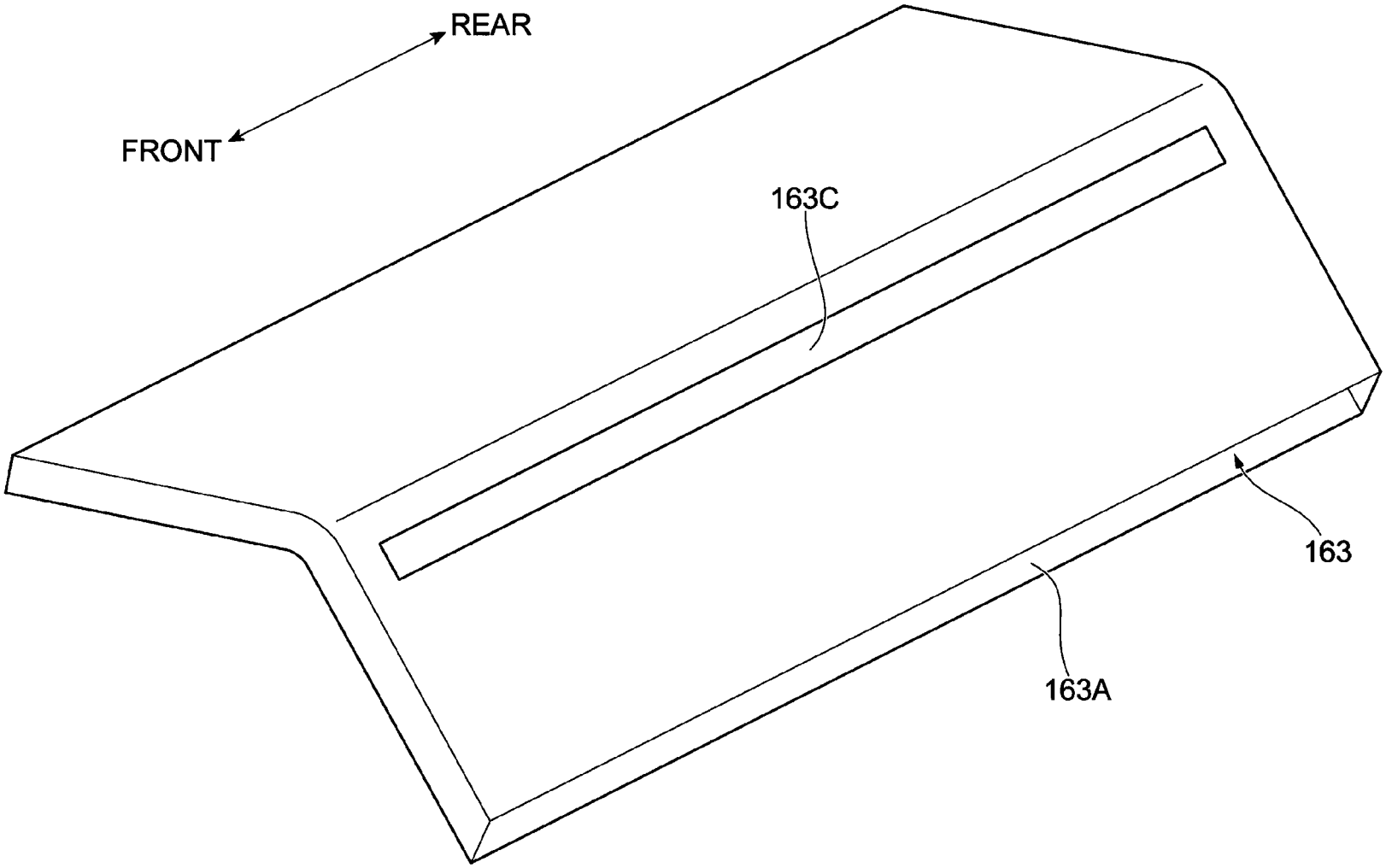
FIG. 8 shows another configuration of the air accommodation space.

When the return flow path 171 is formed, a flow of air returning toward the discharge portions 163C is more likely to be generated. Hence, for example, the discharge portion 163C may be formed so as to extend from the front side to the rear side of the image forming apparatus 1, as shown in FIG. 8, which shows another configuration of the air accommodation space 163.

More specifically, when the return flow path 171 is formed, a flow of air returning toward the discharge portions 163C is likely to be generated even if the discharge portions 163C are not holes. Hence, the discharge portion 163C may have a shape other than the holes.

Figure 9:
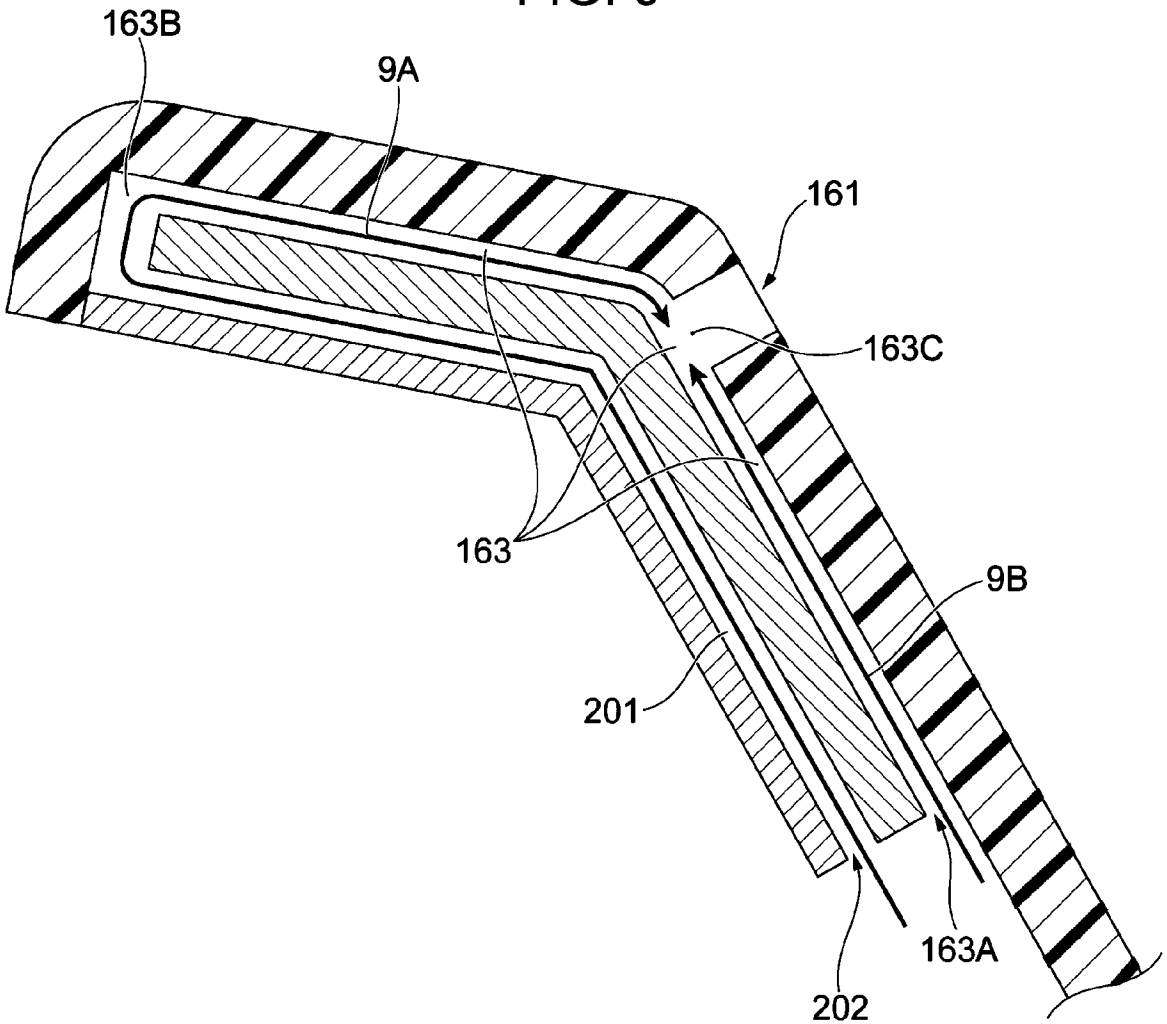
FIG. 9 shows another configuration of a portion IX in FIG. 2.

FIG. 9 shows another configuration of the portion IX in FIG. 2.

In this configuration example, a supply flow path 201, through which air is supplied, is provided on the opposite side of the air accommodation space 163 from the exhaust ports 161.

The air is supplied to the end 163B of the air accommodation space 163 through the supply flow path 201. In this configuration example, the air directed toward the exhaust ports 161 is supplied into the air accommodation space 163 also from the end 163B of the air accommodation space 163.

More specifically, the supply flow path 201 has an inlet 202. The inlet 202 is provided beside the inlet 163A of the air accommodation space 163.

The air that has entered the supply flow path 201 from the inlet 202 passes through the supply flow path 201 and flows toward the end 163B of the air accommodation space 163. Then, from the end 163B, the air enters the air accommodation space 163.

The air that has entered the air accommodation space 163 from the end 163B moves toward the discharge portions 163C, in the arrow 9A direction.

Similarly to the above, the air is also supplied to the air accommodation space 163 from the inlet 163A of the air accommodation space 163. This air also moves toward the discharge portions 163C, in the arrow 9B direction.

Also in this configuration example, the air coming from the end 163B and the air coming from the inlet 163A join together at the portions facing the discharge portions 163C. Hence, also in this configuration example, the amount of the developer contained in the air discharged from the exhaust ports 161 decreases.

Also in this configuration example, the discharge portion 163C may be formed so as to extend from the front side to the rear side of the image forming apparatus 1, as shown in FIG. 8.

An example case where airflows are directed in the directions intersecting (perpendicular to) the longitudinal direction of the developing device 14 and join together has been described above.

Figure 10:
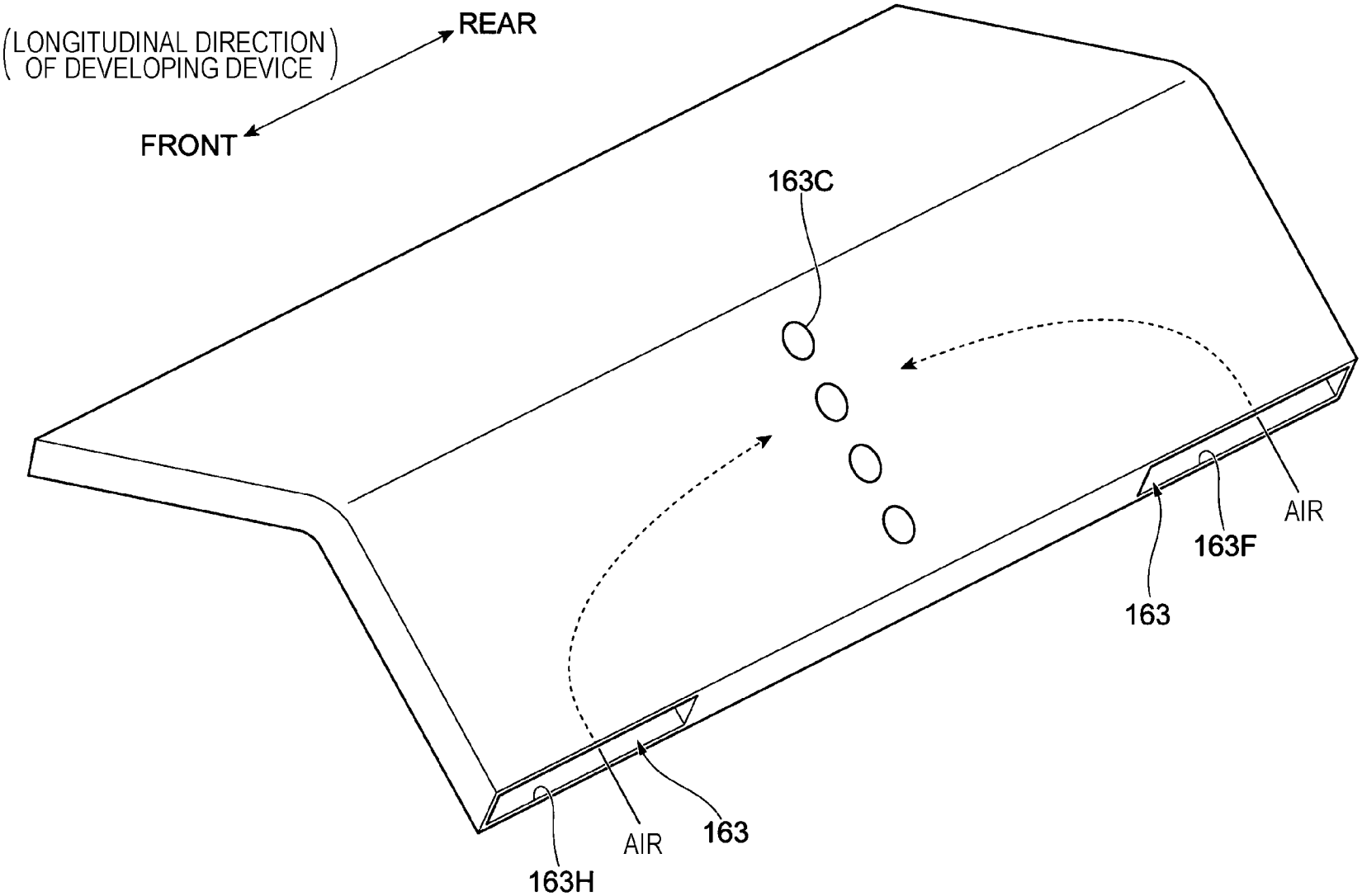
FIG. 10 shows another configuration of the air accommodation space.

However, the configuration is not limited thereto, and, for example, the airflows may be directed in the longitudinal direction of the developing device 14 and joined together, as shown in FIG. 10, which shows another configuration of the air accommodation space 163.

In this configuration example, a first inlet 163H and a second inlet 163F, which are located at different positions in the longitudinal direction of the developing device 14, are provided as inlets, and the air entering from the first inlet 163H and the air entering from the second inlet 163F join together in the air accommodation space 163.

Furthermore, in this configuration example, multiple discharge portions 163C (holes) that are arranged in a line in the direction intersecting (perpendicular to) the longitudinal direction of the developing device 14 are provided at the central portion of the air accommodation space 163 (i.e., the central portion of the air accommodation space 163 in the longitudinal direction of the developing device 14).

In this configuration example, the air that has entered the air accommodation space 163 from the first inlet 163H and the air that has entered the air accommodation space 163 from the second inlet 163F join together at portions facing the discharge portions 163C.

In the above-described configuration examples, example cases where the airflow coming in one direction and the airflow coming in the opposite direction join together have been described.

Figure 11:
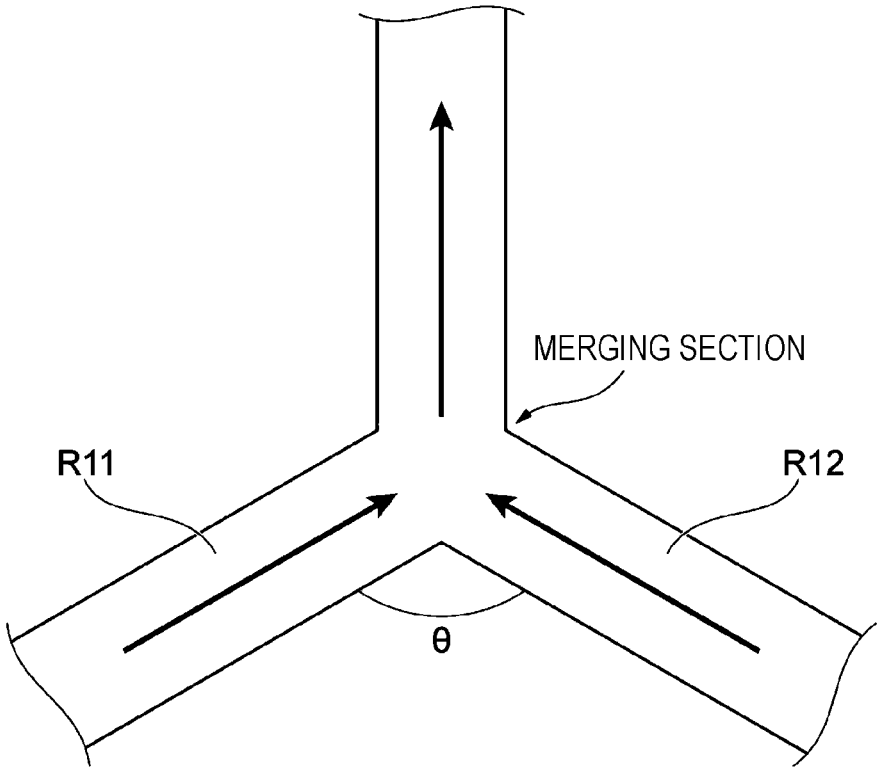
FIG. 11 shows another configuration of a merging section.

However, the configuration is not limited thereto, and, as shown in FIG. 11, which shows another configuration of the merging sections, two flow paths R11 and R12 may be joined together such that the angle θ therebetween is less than 90° to form a merging section.

In the above-described configuration examples, example cases where the airflows join together at the portions facing the discharge portions 163C have been described. However, the airflows may be joined together at a portion where the discharge portions 163C are not provided, as shown in FIG. 11.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a container for accommodating developer, the container having an exhaust port; and a merging section where airflows directed from an interior of the container to the exhaust port join together, wherein a hole is provided in a side of a flow path through which the air directed to the exhaust port passes, and an airflow directed from an upstream side toward the hole and an airflow returning toward the hole after temporarily directed to a downstream side of the hole join together.

2. The developing device according to claim 1, wherein an airflow flowing in one direction and an airflow flowing in a direction opposite to the one direction join together at the merging section.

3. The developing device according to claim 1, wherein the hole includes a plurality of holes.

4. The developing device according to claim 3, wherein the plurality of holes are disposed at different positions in a direction intersecting a direction of the airflows directed from the upstream side to the holes.

5. The developing device according to claim 1, wherein the flow path includes: a first flow path through which the air is temporarily directed to the downstream side of the hole; and a second flow path through which the air temporarily directed to the downstream side returns toward the hole.

6. The developing device according to claim 5, wherein an inlet of the first flow path has a greater area than an outlet of the second flow path.

7. An image forming apparatus comprising:

an image carrier that carries an image; and the developing device according to claim 1, which forms an image on the image carrier.

8. A developing device comprising:

a container for accommodating developer, the container having an exhaust port;

an air accommodation space having an inlet, from which air directed to the exhaust port enters, and an end on a side opposite to the inlet; and a discharge portion located between the inlet and the end of the air accommodation space, the air directed to the exhaust port being discharged from the discharge portion, wherein the discharge portion includes a plurality of discharge portions.

9. The developing device according to claim 8, wherein a gap formed between an inner surface of the container and a facing part corresponding to the inner surface serves as the air accommodation space.

10. The developing device according to claim 8, wherein the plurality of discharge portions are arranged in a direction intersecting a direction of an airflow directed from the inlet toward the end.

11. The developing device according to claim 8, wherein a flow path along which the air temporarily flows toward the end beyond the plurality of discharge portions and then returns toward the plurality of discharge portions is formed in the air accommodation space.

12. The developing device according to claim 11, wherein an inlet of the flow path has a greater area than an outlet of the flow path.

13. The developing device according to claim 8, wherein the air directed to the exhaust port is also supplied from the end of the air accommodation space to the air accommodation space.

14. A developing device comprising:

a container for accommodating developer, the container having an exhaust port;

an air flow path through which air directed to the exhaust port passes; and a joining flow path into which the air directed to the exhaust port flows, the joining flow path joining the air flow path, wherein the air flow path has an inlet, from which the air directed to the exhaust port enters the air flow path, and an end on a side opposite to the inlet, wherein a portion of the air directed to the exhaust port flows directly to the end after entering the air flow path and is then circulated from the end towards the joining flow path before reaching the exhaust port.

15. The developing device according to claim 14, wherein the air flow path includes a first flow path extending in one direction, and a second flow path located on a downstream side of the first flow path in an airflow direction and extending in a direction intersecting the one direction, the first flow path and the second flow path intersect at an intersecting portion, and the joining flow path joins the intersecting portion of the air flow path.

16. The developing device according to claim 15, wherein the joining flow path extends from a side of the intersecting portion opposite to the first flow path toward the intersecting portion and joins the intersecting portion.

* * * * *